US009994035B2

(12) United States Patent
Shinoto et al.

(10) Patent No.: US 9,994,035 B2
(45) Date of Patent: Jun. 12, 2018

(54) FILTER UNIT AND LIQUID EJECTING APPARATUS

(71) Applicant: SEIKO EPSON CORPORATION, Tokyo (JP)

(72) Inventors: Akira Shinoto, Matsumoto (JP); Hitotoshi Kimura, Matsumoto (JP); Takanori Seki, Suwa (JP); Takeshi Iwamuro, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/426,884

(22) Filed: Feb. 7, 2017

(65) Prior Publication Data

US 2017/0225482 A1 Aug. 10, 2017

(30) Foreign Application Priority Data

Feb. 9, 2016 (JP) ..... 2016-022789

(51) Int. Cl.

| | |
|---|---|
| ***B41J 2/175*** | (2006.01) |
| ***B41J 2/14*** | (2006.01) |
| ***B41J 2/19*** | (2006.01) |
| ***B41J 29/02*** | (2006.01) |

(52) U.S. Cl.

CPC ..... *B41J 2/17563* (2013.01); *B41J 2/1752* (2013.01); *B41J 2/1753* (2013.01); *B41J 2/17513* (2013.01); *B41J 2/17523* (2013.01); *B41J 2/17546* (2013.01); *B41J 2/17556* (2013.01); *B41J 2/17596* (2013.01); *B41J 2/19* (2013.01); *B41J 29/02* (2013.01)

(58) Field of Classification Search

CPC ..... B41J 2002/14403; B41J 2/17563; B41J 29/393

See application file for complete search history.

(56) References Cited

U.S. PATENT DOCUMENTS

| | | | | |
|---|---|---|---|---|
| 4,183,029 | A * | 1/1980 | Isayama | B01D 35/143 324/701 |
| 7,416,288 | B2 * | 8/2008 | Takatsuka | B41J 2/18 347/85 |
| 7,931,363 | B2 * | 4/2011 | Burress | B41J 2/0057 347/103 |
| 8,430,469 | B2 * | 4/2013 | Nakamura | B41J 2/04508 347/14 |
| 2005/0134666 | A1 | 6/2005 | Rousseau | |
| 2006/0066698 | A1 * | 3/2006 | Takatsuka | B41J 2/18 347/93 |
| 2008/0030536 | A1 * | 2/2008 | Furukawa | B41J 11/007 347/16 |
| 2009/0027469 | A1 | 1/2009 | Furukawa | |
| 2011/0080457 | A1 * | 4/2011 | Nagamine | B41J 2/085 347/93 |

(Continued)

FOREIGN PATENT DOCUMENTS

| | | |
|---|---|---|
| JP | 2002-086744 | 3/2002 |
| JP | 2002240318 A * | 8/2002 |

(Continued)

*Primary Examiner* — Patrick King
(74) *Attorney, Agent, or Firm* — Workman Nydegger

(57) ABSTRACT

A filter unit which is detachably mounted on a liquid ejecting apparatus including a liquid ejecting section which ejects liquid, the filter unit including a filter which filters the liquid; and a storage medium which stores information on the filter.

16 Claims, 5 Drawing Sheets

(56) References Cited

U.S. PATENT DOCUMENTS

| | | | | |
|---|---|---|---|---|
| 2013/0307910 | A1 | 11/2013 | Matsushita et al. | |
| 2017/0197425 | A1 * | 7/2017 | Smith | B41J 2/17563 |

FOREIGN PATENT DOCUMENTS

| | | |
|---|---|---|
| JP | 2005-138479 | 6/2005 |
| JP | 2005-178387 | 7/2005 |
| JP | 2009-023358 | 2/2009 |
| JP | 2009-028979 | 2/2009 |
| JP | 2014-031017 | 2/2014 |

* cited by examiner

FILTER UNIT AND LIQUID EJECTING APPARATUS

BACKGROUND

1. Technical Field

The present invention relates to a filter unit, and a liquid ejecting apparatus on which the filter unit is mounted.

2. Related Art

In the related art, as an example of an liquid ejecting apparatus, an ink jet printer which is provided with a liquid accommodation unit (ink carriage) which accommodates liquid (ink), a liquid ejecting section (recording head) which ejects liquid, and a supply flow path (ink supply flow path) through which liquid is supplied from the liquid accommodation unit to the liquid ejecting section, and in which printing is performed by ejecting liquid toward a medium has been known.

In such liquid ejecting apparatuses, there is an apparatus provided with an exchangeable filter which filters liquid flowing in a supply flow path (for example, JP-A-2009-28979). In this manner, foreign substances included in liquid which is supplied to the liquid ejecting section are collected using a filter, and it is possible to prevent supplying of liquid from being inhibited due to the filter, by exchanging the filter clogged with the foreign substances.

Meanwhile, in the above described liquid ejecting apparatus, since it is not possible to manage an exchange timing of a filter, there is a case in which the following problem occurs. That is, there is a concern that a filter which still can be normally used may be exchanged, by exchanging the filter earlier than an ideal timing, or a filter which is already incapable of being normally used may be continuously used by exchanging the filter later than the ideal timing.

SUMMARY

An advantage of some aspects of the invention is to provide a filter unit and a liquid ejecting apparatus in which it is possible to exchange a filter which filters liquid supplied to a liquid ejecting section at an appropriate timing.

Hereinafter, means of the invention and operation effects thereof will be described.

According to an aspect of the invention, there is provided a filter unit which is detachably mounted on a liquid ejecting apparatus including a liquid ejecting section which ejects liquid, the filter unit including a filter which filters the liquid, and a storage medium which stores information on the filter.

According to the configuration, it is possible to cause the liquid ejecting apparatus to grasp an exchange timing of a filter unit (filter) based on the information on the filter which is stored in the storage medium. Accordingly, it is possible to exchange the filter unit (filter) at an appropriate timing.

In the filter unit, it is preferable that the storage medium store a value corresponding to an amount of the liquid which passes through the filter.

When an amount of liquid which passes through the filter mounted on the liquid ejecting apparatus increases, an amount of foreign substances such as bubbles collected by the filter increases, and it is not easy for the filter to normally function. Accordingly, in a case in which an amount of liquid which passes through the filter increases, it is preferable to exchange the filter. In this point, according to the configuration, since the storage medium can store a value corresponding to an amount of liquid which passes through the filter, it is possible to exchange the filter at an appropriate timing based on the value.

In the filter unit, it is preferable that the storage medium store information on the liquid ejecting apparatus on which the filter unit is mounted.

According to the configuration, when the filter unit is mounted on one liquid ejecting apparatus, information on the one liquid ejecting apparatus is stored in the storage medium of the filter unit. For this reason, in a case in which the filter unit is detached from the one liquid ejecting apparatus, and is mounted on another liquid ejecting apparatus thereafter, it is possible to cause another liquid ejecting apparatus to grasp the fact that the filter unit which was mounted on the one liquid ejecting apparatus is mounted. In addition, it is possible to confirm a use state of the filter unit in the one liquid ejecting apparatus, by referring to the storage medium of the filter unit, after detaching the filter unit from the one liquid ejecting apparatus.

In the filter unit, it is preferable that the storage medium store information on a date on which the filter unit is mounted on the liquid ejecting apparatus.

There is a case in which an expiration date for use from a use start date, after being mounted on a liquid ejecting apparatus is set, depending on a filter unit (filter). In this point, according to the configuration, since information on the date on which the filter unit is mounted on the liquid ejecting apparatus is stored in the storage medium, it is possible to cause the liquid ejecting apparatus to grasp the expiration date for use based on the use start date of the filter unit.

In the filter unit, it is preferable the storage medium store information on a manufacturing date of the filter unit.

There is a case in which an expiration date for use from a manufacturing date is set, depending on a filter unit (filter). In this point, according to the configuration, since the information on the manufacturing date of the filter unit is stored in the storage medium, it is possible to cause the liquid accommodation unit to grasp the expiration date for use based on the manufacturing date of the filter unit.

In the filter unit, it is preferable that the storage medium store information on the liquid ejecting apparatus capable of mounting the filter unit.

There is a case in which a filter which is appropriate for the liquid ejecting apparatus is different, according to a type or properties of liquid ejected by the liquid ejecting apparatus. In this point, according to the configuration, since the information on the liquid ejecting apparatus on which the filter unit can be mounted is stored, it is possible to cause the liquid ejecting apparatus to grasp whether or not a filter unit appropriate for the liquid ejecting apparatus is mounted.

It is preferable that the filter unit further include a filter chamber which accommodates the filter, and is filled with the liquid, and the storage medium store information on the liquid with which the filter chamber is filled.

According to the configuration, since the filter chamber is filled with liquid, it is not necessary to perform an operation of filling the filter chamber with liquid, after mounting the filter unit on the liquid ejecting apparatus.

When a filter unit including a filter chamber which is filled with another liquid is mounted on a flow path through which one liquid is supplied to a liquid ejecting section, and supplying of liquid to the liquid ejecting section is started, there is a case in which another liquid is mixed into the flow path through which the one liquid is supplied. In this point, according to the configuration, since information on the liquid which is accommodated in the filter chamber in advance is stored in the storage medium, it is possible to cause the liquid ejecting apparatus to grasp whether or not the filter chamber of the mounted filter unit is filled with liquid which should be supplied.

According to another aspect of the invention, there is provided a liquid ejecting apparatus which includes a liquid ejecting section which ejects liquid, a mounting unit on which the filter unit is detachably mounted, and a control unit which cause maintenance of the liquid ejecting section to be performed based on information on a filter which is stored in a storage medium included in the filter unit.

According to the configuration, it is possible to perform maintenance based on information on the filter of the filter unit which is mounted on the mounting unit of the liquid ejecting apparatus. For example, in a case in which the filter comes to an expiration date for use, it is possible to urge exchanging of the filter unit without performing maintenance. In this manner, according to the configuration, it is possible to cause the liquid ejecting apparatus to grasp an exchange timing of the filter unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of a liquid ejecting apparatus will be described with reference to drawings. The liquid ejecting apparatus according to the embodiment is an ink jet printer which performs printing of characters or images on a medium, by ejecting ink as an example of liquid onto a medium such as a sheet.

Figure 1:
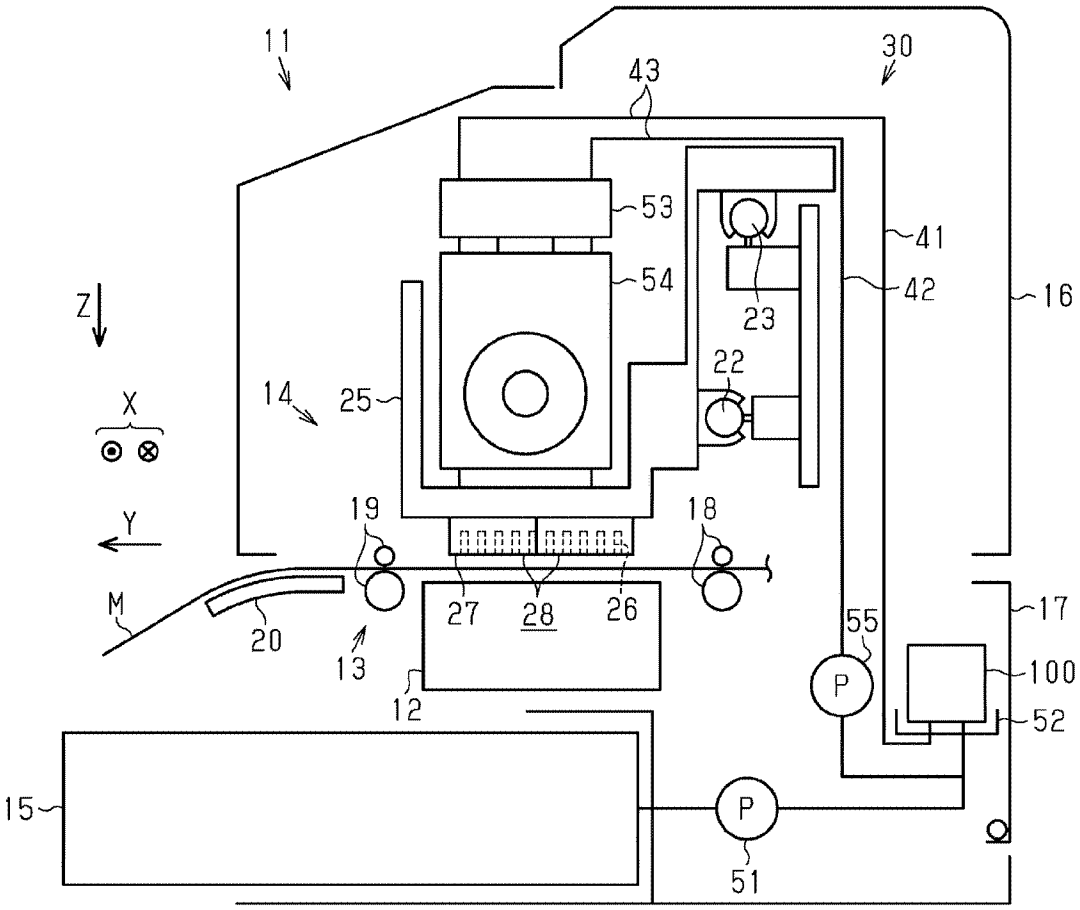
FIG. 1 is a side view which illustrates a schematic configuration of a liquid ejecting apparatus.

As illustrated in FIG. 1, a liquid ejecting apparatus 11 is provided with a transport unit 13 which transports a medium M supported by a support table 12 in a transport direction Y along the surface of the support table 12, a liquid ejecting unit 14 which ejects liquid onto the medium M which is transported, and a liquid accommodation unit 15 which accommodates liquid supplied to the liquid ejecting unit 14.

The support table 12, the transport unit 13, and the liquid ejecting unit 14 are assembled in an apparatus main body 16 which is configured of a housing, a frame, or the like. The support table 12 extends in a width direction (direction orthogonal to paper face in FIG. 1) of the medium M in the liquid ejecting apparatus 11. A cover 17 is attached to the apparatus main body 16 in an openable-closeable manner.

The transport unit 13 is provided with a pair of transport rollers 18 and 19 which are respectively disposed on the upstream side and the downstream side of the support table 12 in the transport direction Y, and a guide plate 20 which is disposed on the downstream side of the pair of transport rollers 19 in the transport direction Y, and guides the medium M while supporting the medium. The transport unit 13 transports the medium M along the surface of the support table 12 and the surface of the guide plate 20, when the pair of transport rollers 18 and 19 are rotated while interposing the medium M therebetween.

The liquid ejecting unit 14 is provided with guide shafts 22 and 23 which extend along a scanning direction X as a width direction of the medium M which is orthogonal to (intersects) the transport direction Y of the medium M, and a carriage 25 which can reciprocate in the scanning direction X by being guided by the guide shafts 22 and 23. The carriage 25 moves in the scanning direction X in association with driving of a carriage motor 24 (refer to FIG. 2).

At least one (two in the embodiment) of liquid ejecting sections 28 which includes a nozzle forming face 27 in which nozzles 26 which eject liquid (ink) are formed is attached to a lower end portion of the carriage 25. The liquid ejecting section 28 is attached to the carriage 25 in a posture in which the nozzle forming face 27 faces the support table 12 with a predetermined interval in a vertical direction Z, and moves in the scanning direction X along with the carriage 25 in association with driving of the carriage motor 24. The liquid ejecting sections 28 are separated with a predetermined interval in the scanning direction X, and are disposed so as to be shifted by a predetermined distance in the transport direction Y.

Figure 2:
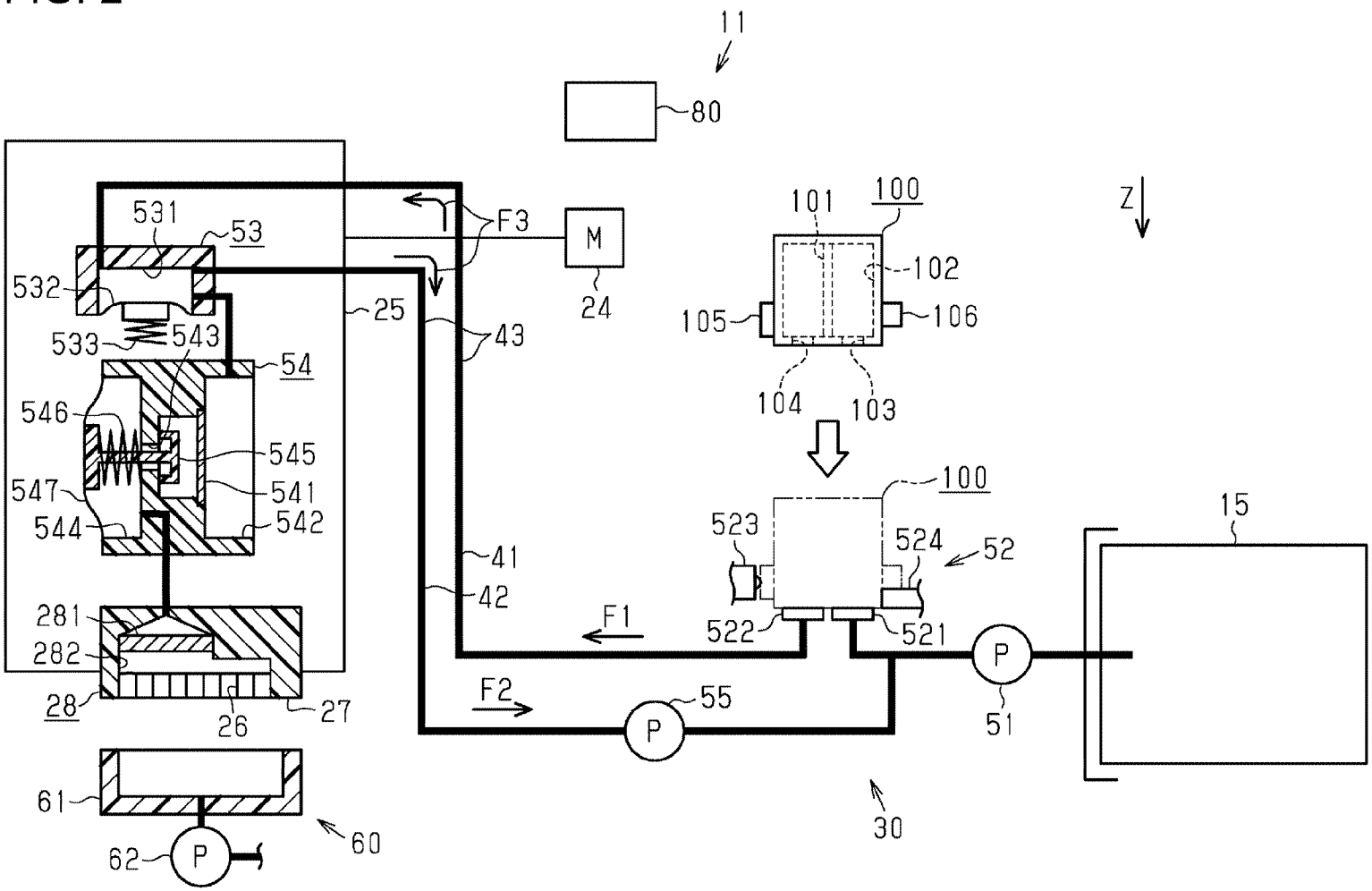
FIG. 2 is a side sectional view which illustrates a schematic configuration of a supply flow path of liquid in the liquid ejecting apparatus.

Meanwhile, as illustrated in FIGS. 1 and 2, a part of a supply mechanism 30 which supplies liquid from the liquid accommodation unit 15 to the liquid ejecting section 28 is attached to the upper side of the carriage 25. A plurality of the liquid accommodation units 15 and the supply mechanisms 30 are provided in each type of liquid.

The liquid accommodation unit 15 may be disposed in the liquid ejecting apparatus 11 in a fixing manner, may be a liquid accommodation unit in which an inlet for injecting liquid is formed, and may be an exchangeable liquid accommodation unit which can be detached from the liquid ejecting apparatus 11. In a case in which the liquid ejecting apparatus 11 is a printer, as liquid which is accommodated in the liquid accommodation unit 15, there is colored ink such as cyan ink, magenta ink, yellow ink, and black ink, or functional fluid which adjusts a fixing state of ink on the medium M.

Subsequently, the supply mechanism 30 which is provided for each type of liquid ejected by the liquid ejecting section 28 will be described in detail.

As illustrated in FIG. 2, the supply mechanism 30 is provided with a supply flow path 41 through which liquid is supplied from the liquid accommodation unit 15 to the liquid ejecting section 28, and a return flow path 42 which forms a circulation flow path 43 which causes liquid to circulate along with the supply flow path 41.

As illustrated in FIG. 2, a supply pump 51 which causes liquid in the supply flow path 41 to flow, a filter unit 100 which filters liquid which passes through, a mounting unit 52 on which the filter unit 100 is detachably mounted, a liquid storage chamber 53 which stores liquid, and a pressure adjusting valve 54 which adjusts a pressure of liquid are provided in the supply flow path 41.

The supply pump 51 may be a diaphragm pump, or the like, and ejects liquid which is suctioned from the liquid accommodation unit 15 side to the liquid ejecting section 28. In this manner, the supply pump 51 supplies liquid accommodated in the liquid accommodation unit 15 to the liquid ejecting section 28. In the following descriptions, supplying of liquid to the liquid ejecting section 28 using the supply pump 51 is also referred to as a "supply operation", and a flow direction of liquid at a time of the supply operation is also referred to as a "supply direction F1".

At a time of non-driving, the supply pump 51 according to the embodiment permits flowing of liquid in the supply direction F1, and functions as one way valve which limits flowing of liquid in a direction opposite to the supply direction F1.

The filter unit 100 includes a first filter 101 as an example of a filter which filters liquid, a filter chamber 102 which accommodates the first filter 101, an inlet port 103 through which liquid is introduced to the filter chamber 102, and an outlet port 104 through which liquid is derived from the filter chamber 102. The filter unit 100 is provided with a storage medium 105 which stores information on the first filter 101, and an engaging portion 106 which is engaged with the apparatus side when being mounted on the liquid ejecting apparatus 11.

The filter chamber 102 may be filled with liquid in advance, which is the same as liquid supplied through the supply flow path 41 including the mounting unit 52 on which the filter unit 100 is mounted. In a case in which the filter chamber 102 is filled with liquid, it is preferable to provide a sealing member (sealing film) so that liquid accommodated in the filter chamber 102 is not leaked to the outside through the inlet port 103 and the outlet port 104.

According to the embodiment, in a state of being mounted on the mounting unit 52, since the filter unit 100 (first filter 101) is provided in the supply flow path 41, liquid passes through the filter unit 100 when the supply operation is performed. For this reason, according to the embodiment, liquid supplied from the liquid accommodation unit 15 to the liquid ejecting section 28 is filtered, using the filter unit 100 when the supply operation is performed.

The storage medium 105 is provided on a side wall of the filter unit 100 so as not to be detached. For this reason, the storage medium 105 is also mounted on the mounting unit 52, when the filter unit 100 is mounted on the mounting unit 52.

As illustrated in FIG. 1, the mounting unit 52 is provided between the supply pump 51 and the liquid storage chamber 53 in the supply flow path 41, and is exposed when opening the cover 17 of the apparatus main body 16. As illustrated in FIG. 2, the mounting unit 52 is provided with a first connecting portion 521 which is connected to the inlet port 103 of the filter unit 100, a second connecting portion 522 which is connected to the outlet port 104 of the filter unit 100, a reading unit 523 which is in contact with the storage medium 105 of the filter unit 100, and a portion to be engaged 524 which is engaged with the engaging portion 106 of the filter unit 100. The first connecting portion 521 and the second connecting portion 522 suppress leaking of liquid from the supply flow path 41 in a case in which the filter unit 100 is not mounted on the mounting unit 52.

The reading unit 523 functions as an interface which connects the liquid ejecting apparatus 11 and the storage medium 105 of the filter unit 100. The reading unit 523 may have a function of writing information in the storage medium 105, in addition to a function of reading information stored in the storage medium 105. In addition, the reading unit 523 may read information stored in the storage medium 105 in a state of being in contact with the storage medium 105, and may read information stored in the storage medium 105 using a wireless communication in a state of not being in contact with the storage medium 105.

The portion to be engaged 524 determines whether or not the mounting unit 52 and the filter unit 100 are suitable for each other. For example, in a case in which there is a supply flow path 41 which supplies one liquid, and a supply flow path 41 which supplies another liquid, it is possible to suppress a situation in which a filter unit 100 of which a filter chamber 102 is filled with another liquid is erroneously mounted on the mounting unit 52 provided in the supply flow path 41 through which the one liquid is supplied. That is, the portion to be engaged 524 is set to a shape different in each supply flow path 41 in which the mounting unit 52 is provided, and similarly, also the engaging portion 106 of a corresponding filter unit 100 is set to a shape different in each supply flow path 41.

The liquid storage chamber 53 includes a recessed portion 531 which communicates with the supply flow path 41 and the return flow path 42, a flexible member 532 which closes an opening of the recessed portion 531, and a spring 533 which urges the flexible member 532 in a direction of decreasing a volume of the liquid storage chamber 53. The liquid storage chamber 53 mitigates a fluctuation in pressure of liquid supplied to the pressure adjusting valve 54 using the supply pump 51, by displacing the flexible member 532.

The pressure adjusting valve 54 is provided with a second filter 541 which filters liquid which passes through, a supply chamber 542 which accommodates the second filter 541, a pressure chamber 544 which communicates with the supply chamber 542 through a communicating hole 543, a valve 545 which is provided between the pressure chamber 544 and the supply chamber 542, and a spring 546 which urges the valve 545 in an valve opening direction. That is, the valve 545 is provided so as to be inserted into the communicating hole 543, and the valve 545 urged by the spring 546 clogs the communicating hole 543.

A part of a wall face of the pressure chamber 544 is configured of a diaphragm 547 which can be deformed in a bending manner along an urging direction of the spring 546. The diaphragm 547 receives a force corresponding to an external pressure (atmospheric pressure) on the outer face side, and receives a force corresponding to a pressure of liquid in the pressure chamber 544 on the inner face side. Accordingly, the diaphragm 547 is displaced in a bending manner according to a change in difference in pressure between a pressure in the pressure chamber 544 and a pressure received on the outer face side.

The supply chamber 542 is held in a pressurized state due to liquid supplied from the liquid accommodation unit 15 in a pressurizing manner. In addition, when a pressure in the pressure chamber 544 is lower than a pressure received on the outer face side, and a difference in pressure between the pressure in the pressure chamber 544 and the pressure received on the outer face side is higher than a predetermined difference in pressure, the valve 545 enters a state in which the pressure chamber 544 and the supply chamber 542 communicate, from a state in which a communication between the pressure chamber 544 and the supply chamber 542 is regulated due to an urging force of the spring 546. Subsequently, when a differential pressure between a pressure in the pressure chamber 544 and a pressure received on the outer face side returns to a predetermined pressure difference, by the flowing of the liquid into the pressure chamber 544 from the supply chamber 542, the valve 545 regulates a communication between the pressure chamber 544 and the supply chamber 542. In this manner, the pressure adjusting valve 54 adjusts a pressure of liquid supplied to the liquid ejecting section 28 through the supply flow path 41, in order to hold a pressure of liquid supplied to the liquid ejecting section 28 to a predetermined pressure.

The liquid ejecting section 28 includes a third filter 281 which filters liquid supplied from the pressure adjusting valve 54, and a common liquid chamber 282 which stores liquid to be supplied to the plurality of nozzles 26. The third filter 281 is a filter provided inside the liquid ejecting section 28, in order to filter liquid which flows into the common liquid chamber 282.

As illustrated in FIG. 2, one end of the return flow path 42 is connected to the liquid storage chamber 53, and the other end thereof is connected between the supply pump 51 and the filter unit 100 in the supply flow path 41. A circulation pump 55 is provided in the return flow path 42. The circulation pump 55 may be a diaphragm pump, or a gear pump, for example. In addition, the circulation pump 55 causes liquid in the return flow path 42 to flow in a "return direction F2" which goes from the liquid storage chamber 53 toward the liquid accommodation unit 15.

In this manner, according to the embodiment, the circulation flow path 43 is configured by including the supply flow path 41 and the return flow path 42. The circulation pump 55 and the filter unit 100 are provided in the circulation flow path 43. For this reason, when liquid in the circulation flow path 43 passes through the filter unit 100 using driving of the circulation pump 55, foreign substances such as bubbles included in the liquid are removed.

In the following descriptions, a direction in which liquid flows using driving of the circulation pump 55 is also referred to as a "circulation direction F3", and an operation of causing liquid to flow in the circulation direction F3 is also referred to as a "circulating operation". The circulation direction F3 is the supply direction F1 in the supply flow path 41, and is the return direction F2 in the return flow path 42, as well. The circulating operation is regularly executed, or is executed based on an instruction of a user of the liquid ejecting apparatus 11.

As illustrated in FIG. 2, a maintenance unit 60 which performs maintenance of the liquid ejecting section 28 is provided in a non-printing region as a region in which the liquid ejecting section 28 does not face the support table 12 in the scanning direction X. The maintenance unit 60 is provided with a cap 61 which performs "capping" in which a space to which the nozzle 26 opens is set to a closed space by being in contact with the liquid ejecting section 28 which is located in the non-printing region, and a suctioning pump 62 which suctions a fluid in the closed space.

The maintenance unit 60 depressurizes the closed space by driving the suctioning pump 62 in a state in which the liquid ejecting section 28 is capped, and performs "capping" in which liquid (fluid) is forcibly suctioned from the nozzle 26 of the liquid ejecting section 28. The capping is maintenance performed in order to moisturize the nozzle 26 of the liquid ejecting section 28, and cleaning is maintenance performed in order to discharge bubbles mixed into the liquid ejecting section 28 to the outside of the liquid ejecting section 28.

Subsequently, an electrical configuration of the liquid ejecting apparatus 11 will be described with reference to FIG. 2.

As illustrated in FIG. 2, the liquid ejecting apparatus 11 is provided with a control unit 80 which integrally controls the apparatus. The control unit 80 controls driving of various configurations of the liquid ejecting apparatus 11 such as the carriage motor 24, the liquid ejecting section 28, the supply pump 51, and the circulation pump 55. The control unit 80 causes liquid to be ejected toward the medium M from the liquid ejecting section 28 in association with transporting of the medium M, or causes a supply operation or a circulating operation to be performed.

In the embodiment, the control unit 80 obtains information stored in the storage medium 105 through the reading unit 523, and determines whether or not it is an exchange timing of the filter unit 100 based on the information, or executes maintenance of the liquid ejecting section 28.

Here, information on a manufacturing date of the filter unit 100 (first filter 101), information on a specification such as an area or a material of the first filter 101, an amount of liquid (hereinafter, also referred to as "allowable liquid amount") which can be stably filtered in liquid which passes through, in the filter 101, or the like, is stored in the storage medium 105.

Information on the liquid ejecting apparatus 11 (for example, model number of liquid ejecting apparatus 11) which can be used by mounting the filter unit 100 including the storage medium 105 is described in the storage medium 105.

In addition, the storage medium 105 stores information on a date on which the filter unit 100 is mounted, after the filter unit 100 is mounted on the mounting unit 52, and information on the liquid ejecting apparatus 11 on which the filter unit 100 is mounted. The storage medium 105 stores an amount of liquid which passed through the first filter 101 (hereinafter, also referred to as "amount of liquid which passes through") after the filter unit 100 is mounted on the mounting unit 52, and a use thereof is started.

Here, information on the liquid ejecting apparatus 11 on which the filter unit 100 is mounted may be information which is expressed by one bit denoting whether or not the filter unit was already mounted on any liquid ejecting apparatus 11, or may be information which can specify a liquid ejecting apparatus 11 on which the filter unit is mounted. As the latter information, there is a model number of the liquid ejecting apparatus 11, a MAC address, or the like.

The amount of liquid which passed through is an amount of liquid obtained by summing up an amount of liquid supplied from the liquid accommodation unit 15 to the liquid ejecting section 28, and an amount of liquid which circulates in the circulation flow path 43 in association with executing of the circulating operation. The former liquid amount can be assumed from a liquid ejecting amount in the liquid ejecting section 28, or a driving form of the supply pump 51, and the latter liquid amount can be assumed from a driving form of the circulation pump 55.

In this manner, according to the embodiment, the control unit 80 determine whether or not a mounted filter unit 100 is suitable for the liquid ejecting apparatus 11 based on information stored in the storage medium 105, or determine whether or not the mounted filter unit 100 was mounted on another liquid ejecting apparatus 11. In addition, the control unit 80 notifies a user of the liquid ejecting apparatus 11 of exchanging of the filter unit 100, when determining that an inappropriate filter unit 100 is mounted.

The control unit 80 determines whether or not it is necessary to exchange the filter unit 100 by determining whether or not the filter unit 100 comes to the expiration date for use, based on information stored in the storage medium 105, or determines whether or not it is necessary to exchange the filter unit 100 by determining whether or not an amount of liquid passed through comes to the allowable liquid amount. In addition, the control unit 80 notifies a user of the liquid ejecting apparatus 11 of exchanging of the filter unit 100, in a case of determining that it is necessary to exchange the filter unit 100.

Subsequently, specifications of the first filter 101 of the filter unit 100, the second filter 541 of the pressure adjusting valve 54, and the third filter 281 of the liquid ejecting section 28 will be described.

First, the respective filters 101, 281, and 541 are formed of a meshed body such as mesh of metal or a resin, a porous body, or a metal plate on which fine through holes are drilled. As a specific example of the meshed body, there is a metallic mesh filter or metallic fiber, for example, a metallic sintered filter obtained by forming a thin line of SUS in a felt shape, or performing compression sintering, an electroforming metallic filter, a metallic filter obtained by performing electron beam processing, a metallic filter obtained by performing laser beam processing, or the like.

It is preferable to set filtrating particle sizes of the respective filters 101, 281, and 541 to 15 μm (0.015 mm) which is smaller than a diameter of an opening of the nozzle 26 (hereinafter, referred to as "nozzle opening"), for example, 20 μm (0.020 mm), in order to prevent foreign substances in liquid from reaching the nozzle opening. In a case in which a stainless steel mesh filter is adopted as the filter, it is preferable to set a filtrating particle size of the filter to a size in twill net weaving (filtrating particle size of 10 μm) which is smaller than the diameter (for example, 20 μm) of the nozzle opening, in order to prevent foreign substances in liquid from reaching the nozzle opening.

It is preferable to set a filtrating particle size of an exchangeable first filter 101 to the same filtrating particle size or less of the second filter 541 and the third filter 281 which are provided in the liquid ejecting apparatus 11. For example, in a case in which a filtrating particle size of the second filter 541 and the third filter 281 is set to a size in twill net weaving (filtrating particle size of 10 μm) which is smaller than the diameter (for example, 20 μm) of the nozzle opening, it is preferable to set the first filter 101 to twill net weaving (filtrating particle size of 5 μm) with a filtrating particle size smaller than those of the second filter 541 and the third filter 281.

Subsequently, an operation of the liquid ejecting apparatus 11 according to the embodiment will be described.

In the liquid ejecting apparatus 11, liquid is ejected from the nozzle 26 of the liquid ejecting section 28 toward the medium M. A supply operation is performed in order to supply liquid to the liquid ejecting section 28, or a circulating operation is performed in order to agitate liquid in the circulation flow path.

In this manner, when the liquid ejecting apparatus 11 is continuously used, and an amount of liquid which passes through reaches the allowable liquid amount or more, a notification of exchanging the filter unit 100 is performed. Thereafter, the filter unit 100 mounted on the mounting unit 52 is exchanged to a new filter unit 100 by a user of the liquid ejecting apparatus 11. In a case in which the filter unit 100 is exchanged, an amount of liquid which passes through which is compared to the allowable liquid amount is reset, since the storage medium 105 included in the filter unit 100 is also exchanged.

Meanwhile, in a case of coming to an expiration date for use from a use start date of the filter unit 100, or an expiration date for use from a manufacturing date of the filter unit 100, a notification of exchanging the filter unit 100 is performed, even in a case in which an amount of liquid which passes through is less than the allowable liquid amount.

A storage medium 105 of a filter unit 100 which is once mounted on one liquid ejecting apparatus 11 is stored with the fact of being mounted on the one liquid ejecting apparatus 11. For this reason, in a case in which a filter unit 100 detached from one liquid ejecting apparatus 11 is mounted on another liquid ejecting apparatus 11, a warning of the fact is notified in another liquid ejecting apparatus 11. In addition, information on the liquid ejecting apparatus 11 which can use the filter unit 100 by mounting thereof is stored in the filter unit 100. For this reason, in a case in which the liquid ejecting apparatus 11 on which the filter unit 100 is mounted is a liquid ejecting apparatus 11 which is incapable of using the filter unit 100, a warning of the fact is notified.

In this manner, in the liquid ejecting apparatus 11 according to the embodiment, a use of an inappropriate filter unit 100 is suppressed, and the filter unit 100 is exchanged at an appropriate timing.

According to the embodiment, it is possible to obtain the following effects.

(1) Since the filter unit 100 is provided with the storage medium 105, it is possible to cause the liquid ejecting apparatus 11 to grasp an exchange timing of the filter unit 100 (first filter 101), based on information on the first filter 101 which is stored in the storage medium 105. Accordingly, it is possible to exchange the filter unit 100 (first filter 101) at an appropriate timing.

(2) When an amount of liquid (amount of liquid which passes through) which passes through the first filter 101 mounted on the liquid ejecting apparatus 11 increases, an amount of foreign substances such as bubbles collected by the first filter 101 increases, and it is not easy for the first filter 101 to normally function. In this point, according to the embodiment, since the storage medium 105 can store the allowable liquid amount as a liquid amount which can be stably filtered in the first filter 101, or the amount of liquid which passes through, it is possible to appropriately notify of an exchange timing of the filter unit 100 based on the liquid amount.

(3) According to the embodiment, when a filter unit 100 is mounted on one liquid ejecting apparatus 11, information on the one liquid ejecting apparatus 11 is stored in the storage medium 105 of the filter unit 100. For this reason, in a case in which the filter unit 100 is mounted on another liquid ejecting apparatus 11, after the filter unit 100 is detached from one liquid ejecting apparatus 11, it is possible to appropriately notify of the fact that the filter unit 100 which was mounted on the one liquid ejecting apparatus 11 is mounted.

(4) It is possible to confirm a use state of the filter unit 100 in the liquid ejecting apparatus 11 by referring to the storage medium 105 of the filter unit 100, after detaching the filter unit 100 from the one liquid ejecting apparatus 11.

(5) Since information on a date on which the filter unit 100 is mounted on the liquid ejecting apparatus 11 is stored in the storage medium 105, it is possible to appropriately notify of an exchange timing of the filter unit 100 according to an expiration date for use based on a use start date of the filter unit 100.

(6) Since information on a manufacturing date of the filter unit 100 is stored in the storage medium 105, it is possible to appropriately notify of an exchange timing of the filter unit 100 according to an expiration date for use, based on a manufacturing date of the filter unit 100.

(7) There is a case in which a first filter 101 preferable for being mounted on the liquid ejecting apparatus 11 is different, depending on a type or properties of liquid ejected by the liquid ejecting apparatus 11. For example, there is a case in which a filtrating particle size or a material of an optimal first filter 101 becomes different depending on a type of liquid, since a size of a solidified substance or chemical properties of the liquid are different. In this point, according to the embodiment, since information on the liquid ejecting apparatus 11 on which the filter unit 100 can be mounted is stored, it is possible to cause the liquid ejecting apparatus 11 to determine whether or not a first filter 101 which is suitable for the liquid ejecting apparatus 11 is mounted.

(8) Since the filter chamber 102 of the filter unit 100 is filled with liquid, it is not necessary to perform an operation of filling the filter chamber 102 with liquid, after mounting the filter unit 100 on the liquid ejecting apparatus 11. For this reason, it is possible to rapidly start to use the liquid ejecting apparatus 11, after mounting the filter unit 100 on the liquid ejecting apparatus 11.

According to the embodiment, the following modifications may be performed.

Figure 3:
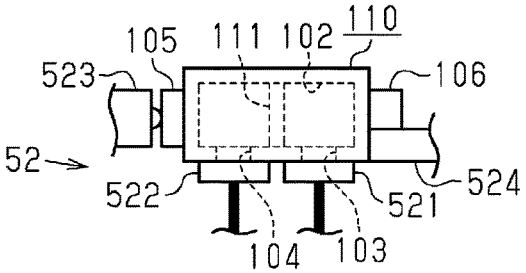
FIG. 3 is a schematic view which illustrates a filter unit according to a first modification example.

An expiration date for use (lifespan) of a filter becomes long when an area of the filter is large. Therefore, as illustrated in FIG. 3, a filter unit 110 including a first filter 111 of which an area is different from that in the first filter 101 may be mounted on the mounting unit 52.

A modification example of the filter unit 100 will be described with reference to FIGS. 4 and 5. In addition, descriptions of a configuration of a member common to that in the above described embodiment will be omitted.

Figure 4:
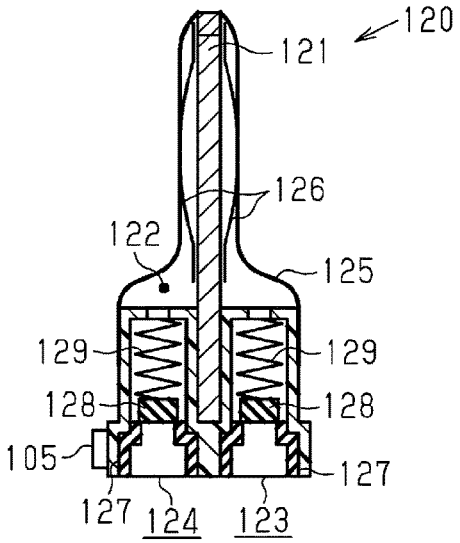
FIG. 4 is a sectional view which illustrates a state of a filter unit according to a second modification example before being mounted.

As illustrated in FIG. 4, a filter unit 120 according to the modification example is provided with a first filter 121 which filters liquid, a filter chamber 122 which accommodates the first filter 121, an inlet port 123 through which liquid is introduced to the filter chamber 122, and an outlet port 124 through which liquid is derived from the filter chamber 122. In addition, the filter unit 120 is provided with an elastic film 125 which forms the filter chamber 122, and a plate spring 126 which urges the elastic film 125 in a direction of increasing a volume of the filter chamber 122.

The inlet port 123 and the outlet port 124 are provided with a sealing member 127 which suppresses leaking of liquid from the inlet port 123 and the outlet port 124, a valve member 128 which limits a flow of liquid through the inlet port 123 and the outlet port 124, and a spring member 129 which urges the valve member 128 toward the sealing member 127. For this reason, in a case in which the filter unit 120 is not mounted on the mounting unit 52, the filter chamber 122 does not communicate with the outside through the inlet port 123 and the outlet port 124 when the valve member 128 closes an opening of the sealing member 127.

In the filter unit 120 illustrated in FIG. 4, gas is suctioned from the filter chamber 122 through the inlet port 123 and the outlet port 124 at a non-use time (at time of manufacturing), and the filter chamber 122 enters a depressurized state. That is, it enters a state in which the elastic film 125 is displaced in a direction of decreasing a volume of the filter chamber 122.

Figure 5:
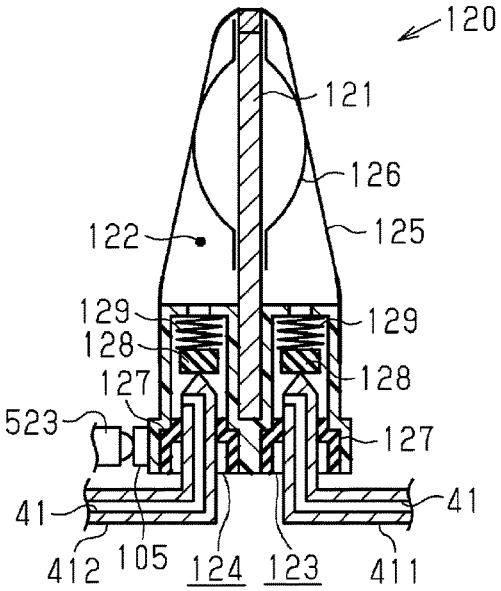
FIG. 5 is a sectional view which illustrates a state of the filter unit according to the second modification example when being mounted.

As illustrated in FIG. 5, when the filter unit 120 is mounted on the mounting unit 52, the valve member 128 of the inlet port 123 is pressed by a first feeding needle 411 in which the supply flow path 41 is formed, and the valve member 128 of the outlet port 124 is pressed by a second feeding needle 412 in which the supply flow path 41 is formed. As a result, when the valve member 128 opens the opening of the sealing member 127, the filter chamber 122 communicates with the supply flow path 41 through the inlet port 123 and the outlet port 124.

Then, it enters a state in which liquid flows into the filter chamber 122 in the depressurized state, from the supply flow path 41 in the pressurized state, a volume of the filter chamber 122 increases, and liquid introduced from the inlet port 123 passes through the first filter 121, and is derived from the outlet port 124. In a state in which a volume of the filter chamber 122 is increased, it enters a state in which the elastic film 125 is urged by the plate spring 126. For this reason, even in a case in which liquid flows in the filter chamber 122, the volume of the filter chamber 122 is rarely changed, and it is possible to prevent a filtering performance of the filter unit 120 from deteriorating.

According to the filter unit 120, since a volume of the filter chamber 122 at a non-use time decreases, it is easy to handle the filter unit 120. In addition, according to the filter unit 120, since a volume of the filter chamber 122 decreases before being mounted, an amount of gas discharged from the filter chamber 122 decreases when filling the filter chamber 122 with liquid, and a concern of bubbles remaining in the supply flow path 41 in association with mounting of the filter unit 120 is reduced. The filter chamber 122 of the filter unit 120 illustrated in FIGS. 4 and 5 may be filled with liquid.

The filter chamber 102 of the filter unit 100 may not be filled with liquid. For example, the filter chamber 102 may be filled with air. In this case, in a case of newly exchanging the filter unit 100, it is preferable to fill the filter chamber 102 with liquid by causing air in the filter chamber 102 to be discharged from the liquid ejecting section 28, by performing cleaning.

Figure 6:
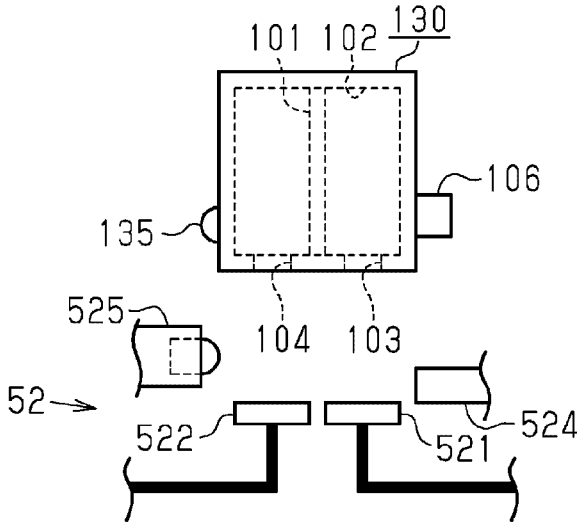
FIG. 6 is a sectional view which illustrates a state of a filter unit according to a third modification example before being mounted.
Figure 7:
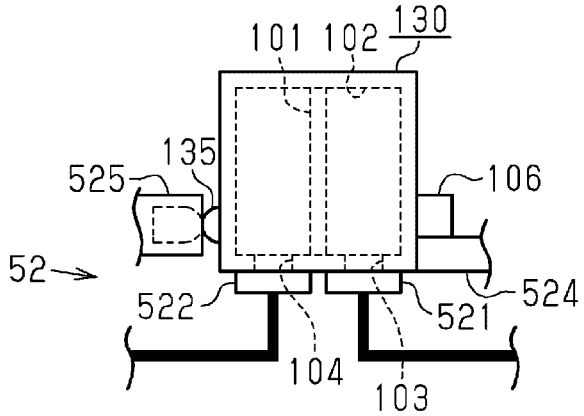
FIG. 7 is a sectional view which illustrates a state of the filter unit according to the third modification example when being mounted.

As illustrated in FIGS. 6 and 7, a portion to be detected 135 may be provided in a filter unit 130, and a detecting portion 525 for detecting the portion to be detected 135 of the filter unit 130 may be provided in the mounting unit 52. In modification examples illustrated in FIGS. 6 and 7, the portion to be detected 135 is a protrusion which is formed so as to protrude from the filter unit 130. The detecting portion 525 is a mechanical switch which is displaced by being pressed by the protrusion when the filter unit 130 is mounted on the mounting unit 52, and outputs a signal corresponding to a detection state to the control unit 80. That is, the control unit 80 determines that the filter unit 130 is mounted on the mounting unit 52 in a case in which the protrusion is displaced by being pressed, and determines that the filter unit 130 is not mounted on the mounting unit 52, in a case in which the protrusion is not pressed, and is not displaced.

In the modification examples illustrated in FIGS. 6 and 7, the control unit 80 may perform process routines which will be described below, in order to determine a mounting state of the filter unit 130. That is, the control unit 80 determines whether or not the filter unit 130 is mounted on the mounting unit 52 based on a detection result of the detecting portion 525. In a case in which the filter unit 130 is not mounted on the mounting unit 52, the control unit 80 temporarily stops the process routine. On the other hand, in a case in which the filter unit 130 is mounted on the mounting unit 52, the control unit 80 drives the supply pump 51, and supplies liquid from the liquid accommodation unit 15 to the liquid ejecting section 28.

In this manner, it is possible to determine a mounting state of the filter unit 130 on the mounting unit 52 based on a detection result of the detecting portion 525. In addition, there is no case in which the supply pump 51 is driven in a state in which the filter unit 130 is not mounted on the mounting unit 52. Accordingly, a supply operation is performed in a state in which the filter unit 130 is detached from the mounting unit 52, and it is possible to prevent liquid from leaking from the first connecting portion 521 of the mounting unit 52.

In the modification example illustrated in FIGS. 6 and 7, a first electrical contact point and a second electrical contact point are provided in the detecting portion 525, and an electrical connection unit which causes the first electrical contact point and the second electrical contact point to be electrically connected when mounting the filter unit 130 may be provided in the portion to be detected 135. According to this, since the first electrical contact point and the second electrical contact point are electrically connected when the filter unit 130 is mounted, and on the other hand, the first electrical contact point and the second electrical contact point are not electrically connected when the filter unit 130 is not mounted, it is possible to determine whether or not the filter unit 130 is mounted according to an electrical connection state between the contact points. In addition, the electrical connection unit may be provided in the detecting portion 525, and the first electrical contact point and the second electrical contact point may be provided in the portion to be detected 135.

In a case in which liquid filled in the filter chamber 102 of the filter unit 100 is conductive liquid, the first electrical contact point and the second electrical contact point may be set to electrode pins which are inserted into the liquid accommodation unit 15. In this manner, it is possible to determine whether or not the filter unit 100 is mounted on the mounting unit 52, since liquid filled in the filter chamber 102 functions as the electrical connection unit.

The detecting portion 525 may be provided in the cover 17 of the apparatus main body 16. In this manner, it is possible to confirm whether or not the cover 17 is closed, in addition to the mounting state of the filter unit 130 on the mounting unit 52, based on a detection result of the detecting portion 525.

The detecting portion 525 may be an optical sensor which optically detects mounting of the filter unit 100. For example, the detecting portion may be a reflective optical sensor, or a transmission-type optical sensor. In a case in which the detecting portion 525 is an optical sensor, the portion to be detected may be set to a light shielding unit which shields light, or a reflecting unit which reflects light.

Figure 8:
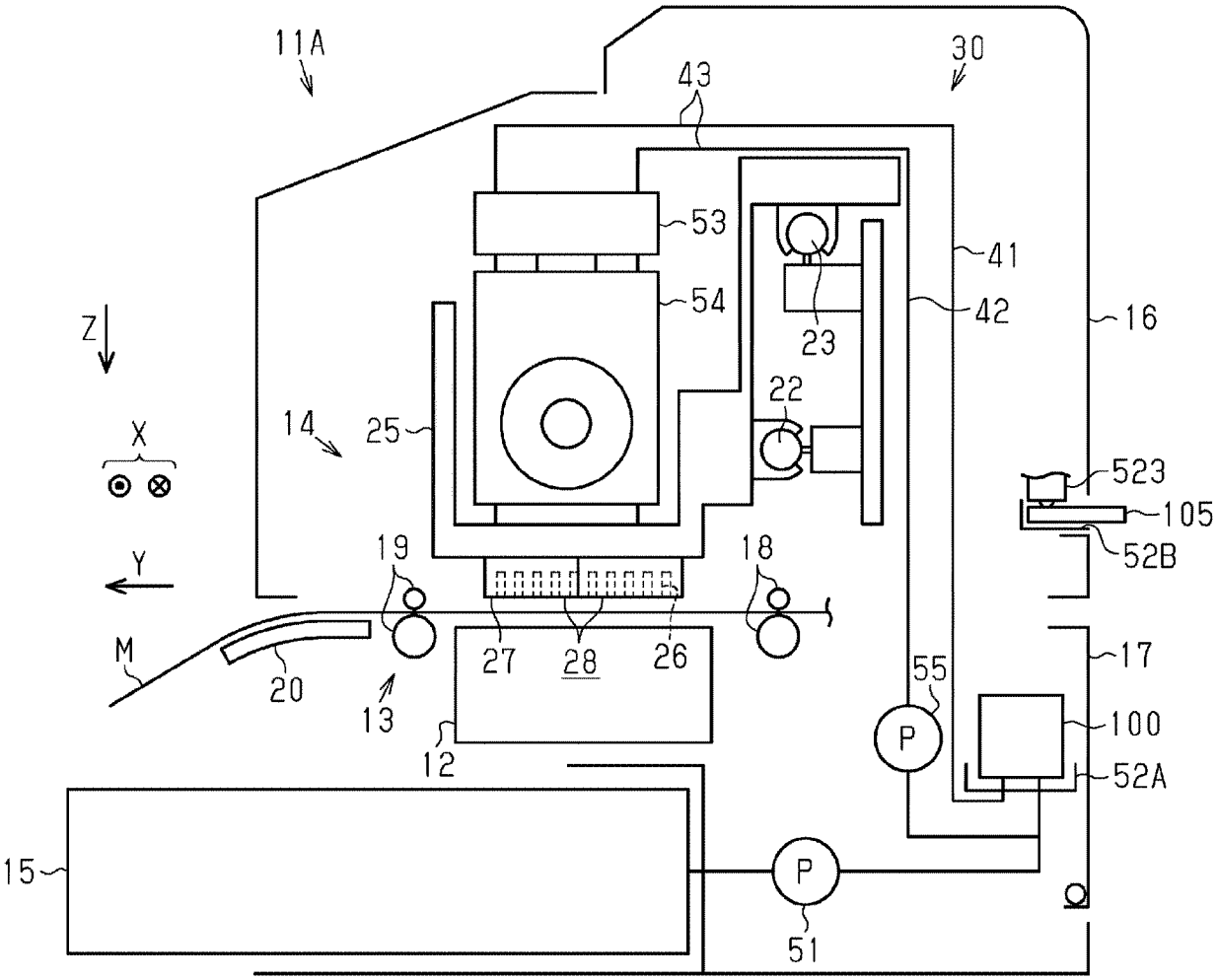
FIG. 8 is a side view which illustrates a schematic configuration of a liquid ejecting apparatus according to a fourth modification example.

The storage medium 105 may be separated from the filter unit 100. In this case, like a liquid ejecting apparatus 11A illustrated in FIG. 8, it is preferable to be provided with a first mounting unit 52A for mounting the filter unit 100, and a second mounting unit 52B for mounting the storage medium 105. It is preferable that the second mounting unit 52B be provided vertically upward compared to the first mounting unit 52A, in order to suppress attaching of liquid to the second mounting unit 52B, in a case in which liquid leaks from the first mounting unit 52A.

The second mounting unit 52B may be provided on the front face of the liquid ejecting apparatus 11, and may be provided in the vicinity of the liquid accommodation unit 15.

The liquid ejecting apparatus 11 may not include the return flow path 42 and the circulation pump 55. That is, the liquid ejecting apparatus 11 may include only the supply flow path 41, without including the circulation flow path 43.

Liquid may be supplied from a liquid container for a supplement such as a liquid accommodating pack, or a liquid accommodating bottle, without providing the liquid accommodation unit 15 in the liquid ejecting apparatus 11. That is, it may be a configuration in which a connecting unit (for example, liquid supply tube) which connects a liquid container and the supply flow path 41 is provided, the liquid container and the supply flow path 41 are connected by the connecting unit, and liquid is directly supplied from the liquid container. The liquid container which is connected to the connecting unit may be accommodated in a tray or a case which is provided at the periphery of the liquid ejecting apparatus 11, and may be hung on a hook which is provided at the periphery of the liquid ejecting apparatus 11.

The engaging portion 106 may not be provided in the filter unit 100, and the portion to be engaged 524 may not be provided in the mounting unit 52. In this case, the control unit 80 may determine suitability between the filter unit 100 and the mounting unit 52 based on a type of liquid to be filled in the filter chamber 102, which is stored in the storage medium 105 of the filter unit 100 which is mounted on the mounting unit 52.

That is, like the filter unit 100 according to the embodiment, in a case in which the filter chamber 102 is filled with liquid, a filter unit 100 of which a filter chamber 102 is filled with different liquid is prepared, for each supply flow path 41 through which liquid of a different type is supplied. For this reason, when a filter unit 100 with a filter chamber 102 which is filled with another liquid (for example, cyan ink) is mounted on the mounting unit 52 of the supply flow path 41 through which one liquid (for example, black ink) is supplied, another liquid is mixed into the supply flow path 41 which supplies the one liquid. Therefore, information on a type of liquid which fills the filter chamber 102 is stored in the storage medium 105 of the filter unit 100, and whether or not liquid supplied through the supply flow path 41 and liquid which fills the filter chamber 102 of the filter unit 100 match may be determined based on the information. In this manner, it is possible to prevent another liquid from being mixed into the supply flow path 41 through which one liquid is supplied.

A value corresponding to an amount of liquid which passes through the first filter 101 may be a ratio of an amount of liquid which passes through to the allowable liquid amount, and may be a difference obtained by subtracting the amount of liquid which passes through from the allowable liquid amount.

In the above described embodiment, a plurality of pieces of information are exemplified as information to be stored in the storage medium 105 of the filter unit 100; however, the storage medium 105 may store at least one piece of information for determining an exchange timing of the filter unit 100. In addition, the control unit 80 of the liquid ejecting apparatus 11 may determine an exchange timing of the filter unit 100, based on one piece of information stored in the storage medium 105.

The liquid ejecting apparatus 11 may not be provided with the carriage 25 which holds the liquid ejecting section 28, and may be a line head type which includes a line head of which a printing range extends to the entire width of the medium M.

The medium M is not limited to a sheet, may be a plastic film, a thin plate member, or the like, may be cloth which is used in a textile printing apparatus, or the like, clothes such as T-shirts, or may be a three-dimensional object such as stationery or table-wear.

Liquid ejected by the liquid ejecting section 28 is not limited ink, and may be a liquid body, or the like, in which particles of a functional material are melted, diffused, or mixed in liquid, for example. It may be a configuration in which recording is performed by ejecting a liquid body including a material such as an electrode material, or a color material (pixel material) which is used when manufacturing, for example, a liquid crystal display, an EL (electroluminescence) display, a surface emission display, or the like, in a form of dispersion, or dissolution.

Subsequently, technical ideas which can be grasped from the above described embodiment and another embodiment will be additionally described. The technical ideas which will be described below are ideas for exchanging the first filter 101 which filters liquid supplied to the liquid ejecting section 28 at an appropriate timing.

(a) A filter unit for solving the above described problem is a filter unit which is detachably mounted on a liquid ejecting apparatus including a liquid ejecting section which ejects liquid, and includes a filter which filters the liquid, and a portion to be detected which is detected by a detecting portion of the liquid ejecting section when being mounted on the liquid ejecting section.

According to the configuration, it is possible to grasp the fact that the filter unit is mounted on the liquid ejecting apparatus when the filter unit is mounted on the liquid ejecting apparatus. For this reason, it is possible to cause the liquid ejecting apparatus to grasp a timing in which the filter unit is mounted, and manage an exchange timing of the filter unit based on the timing.

(b) The liquid ejecting apparatus for solving the above described problem is provided with the liquid ejecting section which ejects liquid, a mounting unit on which the filter unit including a filter which filters the liquid is detachably mounted, and a detecting portion which detects the portion to be detected included in the filter unit when the filter unit is mounted on the mounting unit.

According to the configuration, it is possible to obtain the same operation effect as that of the above described filter unit, in the liquid ejecting apparatus.

(c) It is preferable that the above described liquid ejecting apparatus include a control unit which controls the liquid ejecting section based on a detection result of the detecting portion.

According to the configuration, it is possible to prevent liquid from being ejected from the liquid ejecting section, in a case in which the filter unit is not mounted on the liquid ejecting apparatus.

(d) The above described liquid ejecting apparatus further includes a supply flow path which is connected to the liquid ejecting section so as to supply liquid, and a flow mechanism which causes liquid in the supply flow path to flow, the filter unit is mounted on the supply flow path, and it is preferable that the control unit do not drive the flow mechanism, in a case in which mounting of the filter unit is not detected.

According to the configuration, it is possible to prevent the flow mechanism from being driven in a state in which the filter unit is not mounted. For this reason, it is possible to suppress a situation in which liquid leaks from the supply flow path, or bubbles are mixed into the supply flow path.

The entire disclosure of Japanese Patent Application No. 2016-022789, filed Feb. 9, 2016, is expressly incorporated by reference herein.

What is claimed is:

1. A filter unit which is detachably mounted on a liquid ejecting apparatus including a liquid ejecting section which ejects liquid, the filter unit comprising:

a filter which filters the liquid;

a filter chamber which accommodates the filter;

an outlet port through which the liquid is derived from the filter chamber; and a storage medium which stores information on the filter and provided at a position above the outlet port when the filter unit is mounted on the liquid ejecting apparatus, wherein the storage medium is positioned on a side of the filter unit at a position between a top side and a bottom side of the filter unit.

2. The filter unit according to claim 1, wherein the storage medium stores a value corresponding to an amount of the liquid which passes through the filter.

3. The filter unit according to claim 1, wherein the storage medium stores information on the liquid ejecting apparatus on which the filter unit is mounted.

4. The filter unit according to claim 1, wherein the storage medium stores information on a date on which the filter unit is mounted on the liquid ejecting apparatus.

5. The filter unit according to claim 1, wherein the storage medium stores information on a manufacturing date of the filter unit.

6. The filter unit according to claim 1, wherein the storage medium stores information on the liquid ejecting apparatus capable of mounting the filter unit.

7. The filter unit according to claim 1, wherein the filter chamber is filled with the liquid, and the storage medium store information on the liquid with which the filter chamber is filled.

8. The filter unit according to claim 1, further comprising:

a portion to be detected which is detected by a detecting portion of the liquid ejecting section when being mounted on the liquid ejecting section.

9. A liquid ejecting apparatus comprising:

a liquid ejecting section which ejects liquid;

a mounting unit on which the filter unit according to claim 1 is detachably mounted; and a control unit which causes maintenance of the liquid ejecting section to be performed, based on information on a filter which is stored in a storage medium included in the filter unit.

10. The liquid ejecting apparatus according to claim 9, wherein, in a case of determining that it is necessary to exchange the filter unit based on information on the filter, a notification of exchanging the filter unit is performed.

11. The filter unit according to claim 1, wherein the storage medium stores information on a model number of the liquid ejecting apparatus capable of mounting the filter unit.

12. The filter unit according to claim 1, wherein the filter chamber is filled with a quantity of liquid before being mounted on the liquid ejecting apparatus.

13. The filter unit according to claim 1, wherein the filter chamber comprises an elastic wall that is expandable to increase a volume of the filter chamber.

14. The filter unit according to claim 13, the filter unit further comprising a biasing member biasing the elastic wall in a direction of increasing the volume of the filter chamber.

15. The filter unit according to claim 1, wherein the filter chamber is in a reduced pressure state until being mounted on the liquid ejecting apparatus.

16. The filter unit according to claim 1, the filter unit further comprising an engaging portion arranged at a position above the outlet port, wherein the engaging portion is adapted to have a shape that allows the filter unit to be mounted only in a particular supply flow path.

* * * * *